US007722373B2

(12) United States Patent
Nemoto

(10) Patent No.: US 7,722,373 B2
(45) Date of Patent: May 25, 2010

(54) ELECTRICAL CONNECTOR WITH A SLIDABLE LOCKING MEMBER

(75) Inventor: Takashi Nemoto, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 12/417,865

(22) Filed: Apr. 3, 2009

(65) Prior Publication Data

US 2009/0258523 A1 Oct. 15, 2009

(30) Foreign Application Priority Data

Apr. 11, 2008 (JP) ..... 2008-103141

(51) Int. Cl.
*H01R 13/62* (2006.01)
*H01R 13/15* (2006.01)

(52) U.S. Cl. ..... 439/260; 439/325

(58) Field of Classification Search ..... 439/325, 439/260, 345, 495, 67
See application file for complete search history.

(56) References Cited

U.S. PATENT DOCUMENTS 6,551,128 B2 * 4/2003 Asai ..... 439/495
7,086,893 B2 * 8/2006 Liu et al. ..... 439/495
7,291,039 B2 * 11/2007 Shin ..... 439/495
7,297,020 B2 * 11/2007 Takahira ..... 439/495
7,361,042 B2 * 4/2008 Hashimoto et al. ..... 439/260
2008/0160818 A1 * 7/2008 Liu et al. ..... 439/345

FOREIGN PATENT DOCUMENTS

JP 2007-323867 A 12/2007

* cited by examiner

*Primary Examiner*—Chandrika Prasad
(74) *Attorney, Agent, or Firm*—Frishauf, Holtz, Goodman & Chick, P.C.

(57) ABSTRACT

A connector which makes it possible to positively maintain a locked state of an actuator, even if a flat cable is pulled. The actuator is mounted on a housing in a manner pivotally movable between an open position for accommodating a front end of an FPC in an accommodating space and a closed position for pressing the front end of the FPC against contact portions of contacts. Locking members are mounted on the housing in a manner slidable between a locked position for inhibiting the actuator in the closed position from opening and an unlocked position for allowing the actuator to open, along a direction of arrangement of the contacts.

3 Claims, 24 Drawing Sheets

ELECTRICAL CONNECTOR WITH A SLIDABLE LOCKING MEMBER

BACKGROUND OF THE INVENTION

1. Field of the Invention

This invention relates to a connector, more particularly to a connector which electrically connects a flat object to be connected, such as an FPC (Flexible Printed Circuit) or an FFC (Flexible Flat Cable), and the other object to be connected with each other.

2. Description of the Related Art

Conventionally, there has been proposed a connector for flat cables (see Japanese Laid-Open Patent Publication (Kokai) No. 2007-323867).

This connector is comprised of a housing, a plurality of contacts, an actuator, and a pair of locking portions.

The housing includes an insertion opening for inserting a front end of the flat cable. The housing has opposite ends formed with auxiliary fitting-accommodating recesses.

A plurality of contacts are disposed in the housing at equally-spaced intervals.

The actuator is attached to the housing such that it is rotatable between an open position and a closed position. The actuator has opposite ends formed with locked portions which have a substantially protrusion-like shape.

Each of a pair of locking portions is accommodated in the associated auxiliary fitting-accommodating recess, and is fixed to the housing. The locking portion is made of a metal plate having elasticity, and has a substantially claw-like shape.

When the actuator is in the open position, it is possible to insert the flat cable into the insertion opening of the housing. When the actuator is in the closed position, the actuator covers the insertion opening of the housing, and pushes the flat cable against the contact.

When the actuator is rotated from the open position to the closed position, the locked portions of the actuator push aside the locking portions by elastically deforming the same against spring force thereof, to thereby go under the locking portions. This causes the locked portions to be hooked on the locking portions, thereby the actuator is locked in the closed position.

When the actuator in the locked state is rotated to the open position, the locked portions of the actuator push aside the locking portions by elastically deforming the same against the spring force thereof, whereby the actuator is unlocked. This makes it possible to make the actuator reach to the open position.

In the above-described connector, a locking member is formed by a metal plate having elasticity, and an area of engagement of the locked portion of the actuator and the locking portion is narrow. Therefore, if the flat cable is pulled in a direction of the height of the connector by some cause, there is a fear that the actuator is released from the locked state, whereby the flat cable comes off the connector.

SUMMARY OF THE INVENTION

The present invention has been made in view of these circumstances, and an object thereof is to provide a connector which makes it possible to positively maintain a locked state of an actuator even if an object to be connected is pulled in the direction of the thickness thereof.

To attain the above object, the present invention provides a connector comprising a housing that has an accommodating space for accommodating part of a flat object to be connected, a plurality of contacts that are fixed in the housing, an actuator which is mounted on the housing such that the actuator is pivotally movable between an open position for accommodating part of the object to be connected into the accommodating space and a closed position for pressing part of the object to be connected against the contacts, and a locking member which is mounted on the housing such that the locking member is slidable between a locked position to inhibit the actuator in the closed position from opening and an unlocked position to allow the actuator in the closed position to open, along a direction which is orthogonal to a direction of thickness of part of the object to be connected.

With the arrangement of the connector according to the present invention, the locking member is slidable between the unlocked position and the locked position along the direction which is orthogonal to the direction of the thickness of part of the object to be connected which is accommodated in the accommodating space. Therefore, even if the object to be connected is pulled in the direction of the thickness thereof, the locking member is not moved in the direction of the thickness of the object to be connected.

Preferably, the direction of sliding of the locking member is a direction of arrangement of the contacts.

Preferably, the direction of sliding of the locking member is substantially orthogonal to both of the direction of the thickness of part of the object to be connected and a direction of arrangement of the contacts.

According to this invention, it is possible to positively maintain the locked state of the actuator, even if the object to be connected is pulled.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1A:
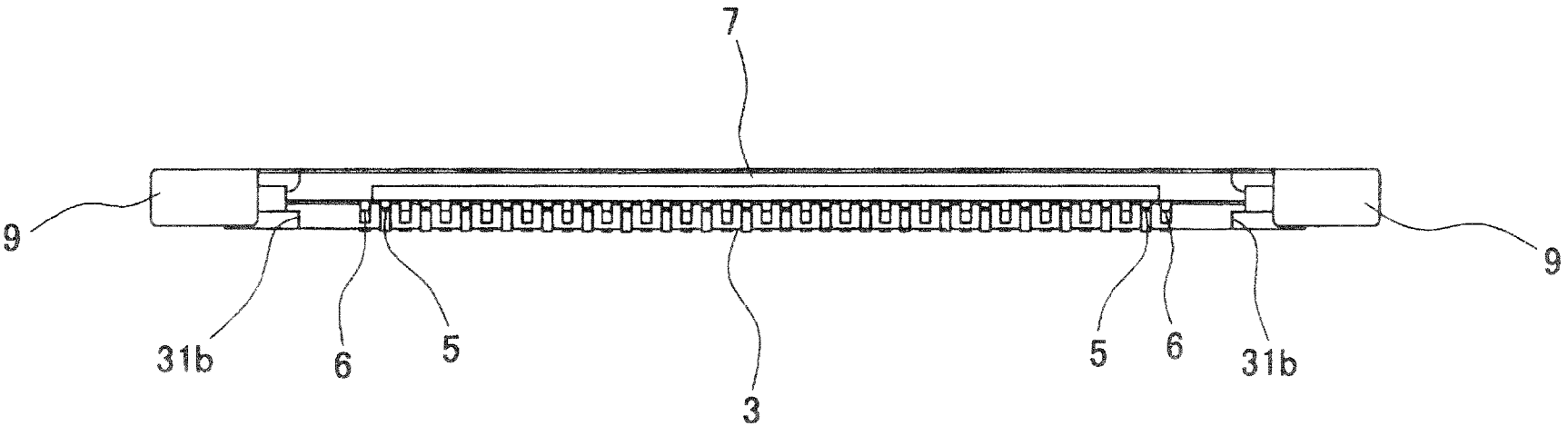
FIG. 1A is a front view of a connector according to a first embodiment of the present invention.
Figure 1B:
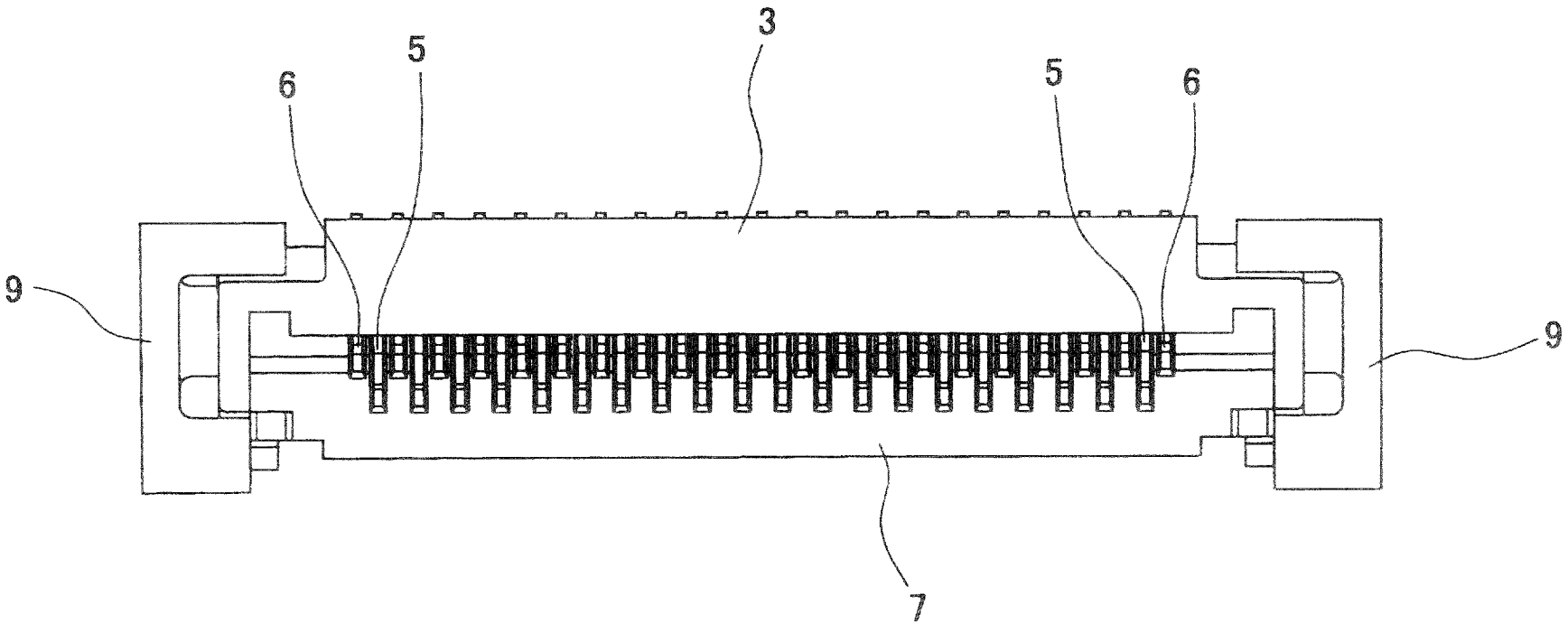
FIG. 1B is a plan view of the same.
Figure 1C:
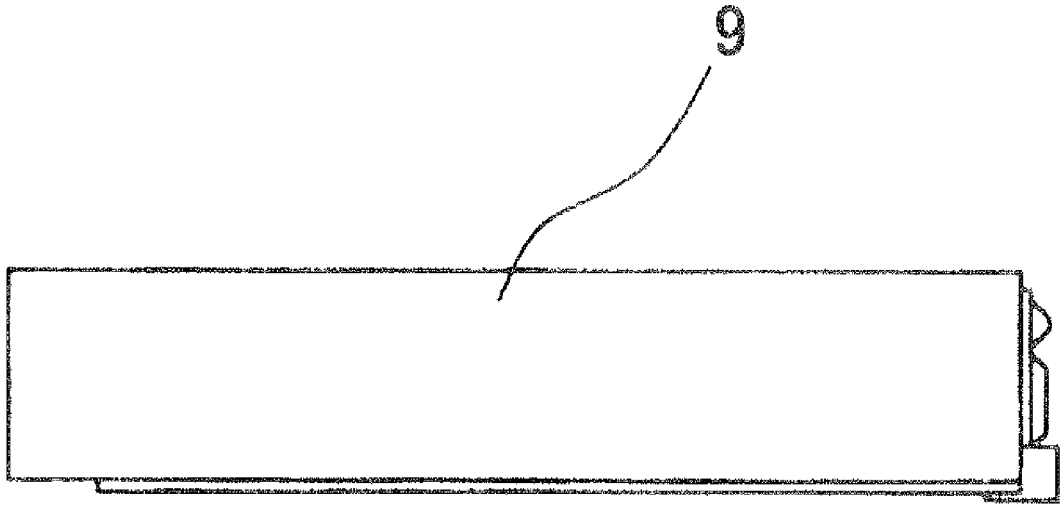
FIG. 1C is a side view of the same.

As shown in FIGS. 1A, 1B, and 1C, the connector is comprised of a housing 3, a plurality of contacts 5 and 6, an actuator 7, and locking members 9. The connector is mounted on a printed board (not shown) which is one of objects to be connected, and electrically connects an FPC (flat object to be connected) 21 which is the other of objects to be connected appearing in FIG. 5, to the printed board.

Figure 2:
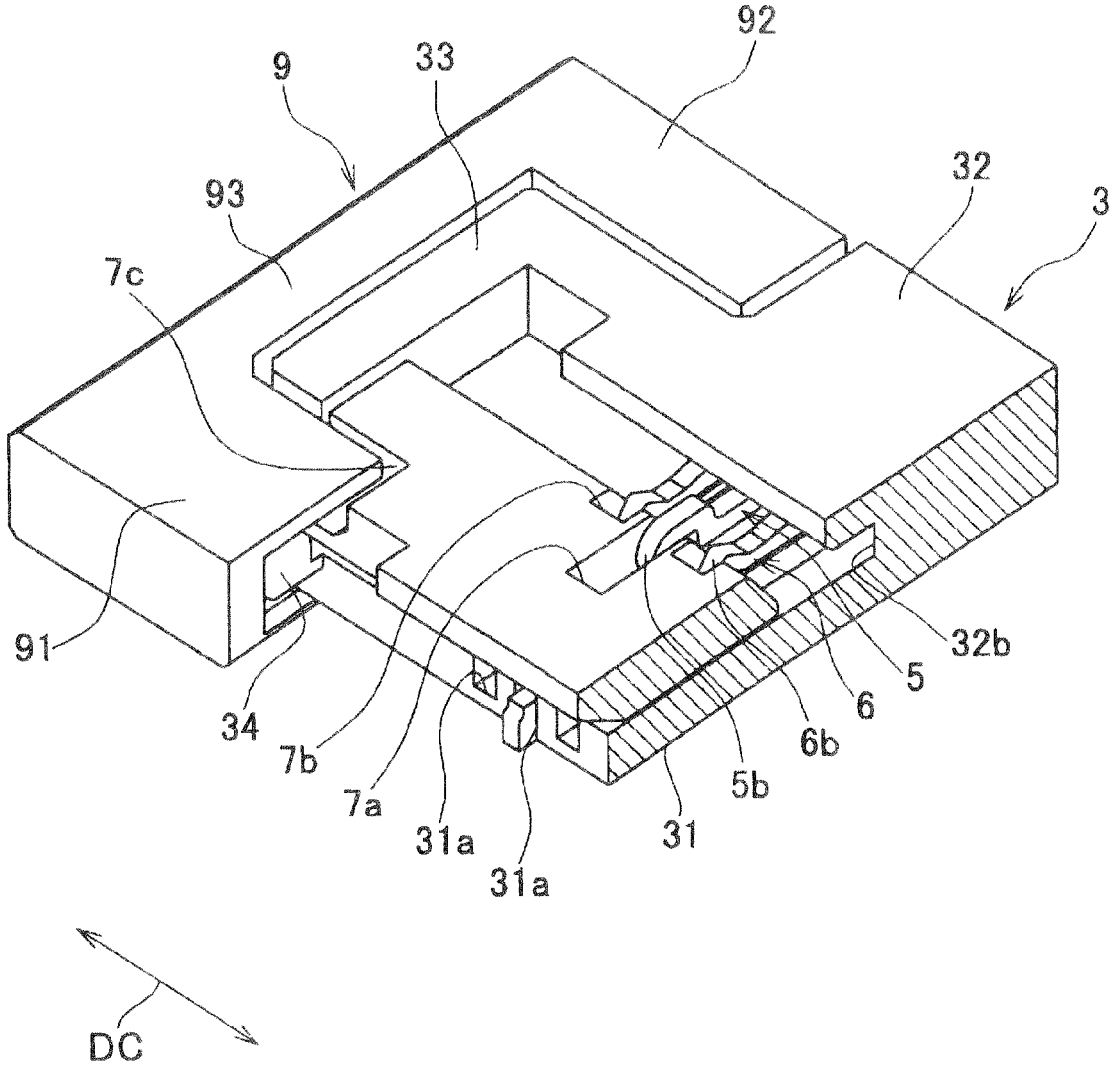
FIG. 2 is a cross-sectional view of the FIG. 1 connector in a state in which a locking portion of the FIG. 1 connector is in a locked position, and an actuator in a closed position is locked.
Figure 3:
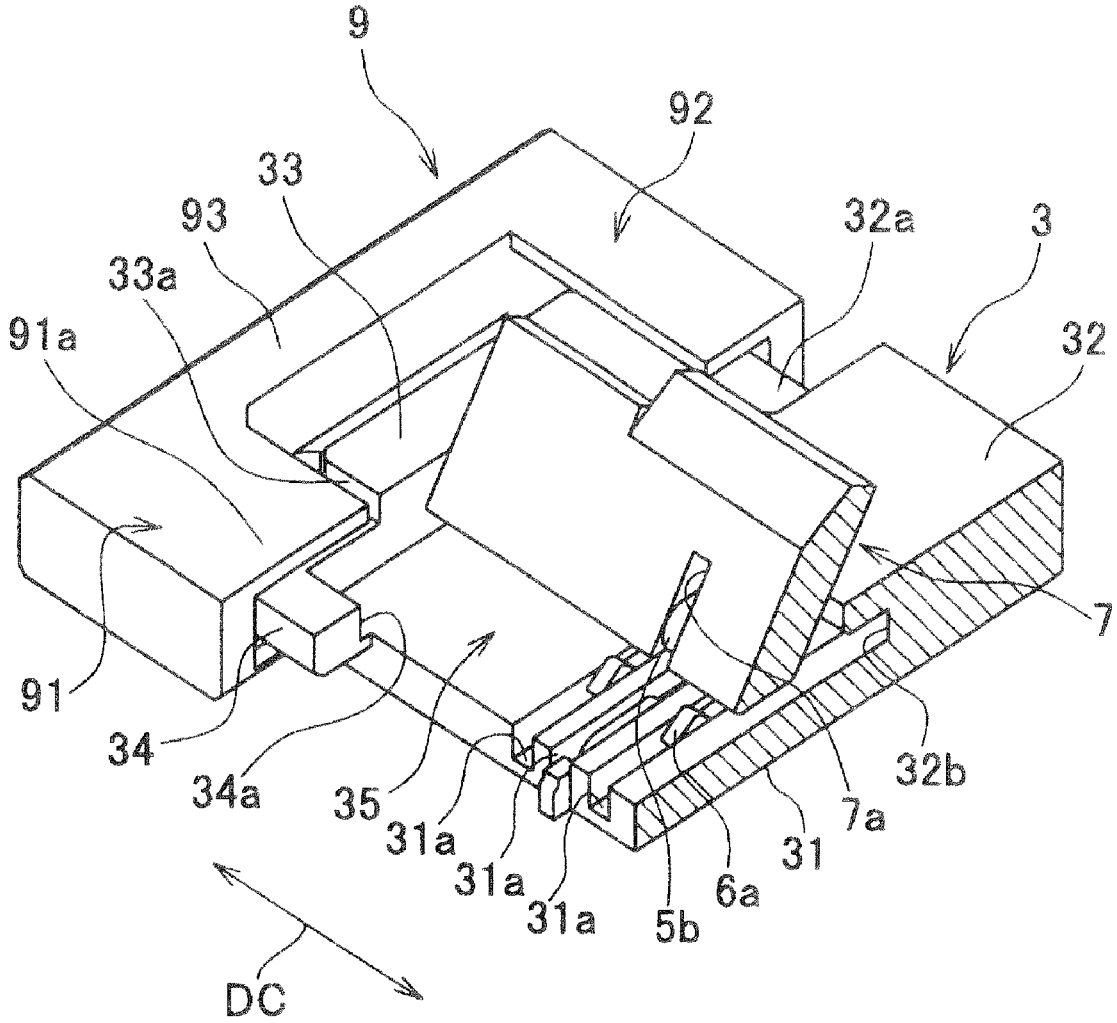
FIG. 3 is a cross-sectional view of the FIG. 1 connector in a state in which the locking portion of the FIG. 1 connector is in the unlocked position, and the actuator is in an open position.

As shown in FIGS. 2 and 3, the housing 3 includes a base portion 31, a rear wall portion 32, side wall portions 33, and locking portions 34, and is made of a synthetic resin.

Figure 4:
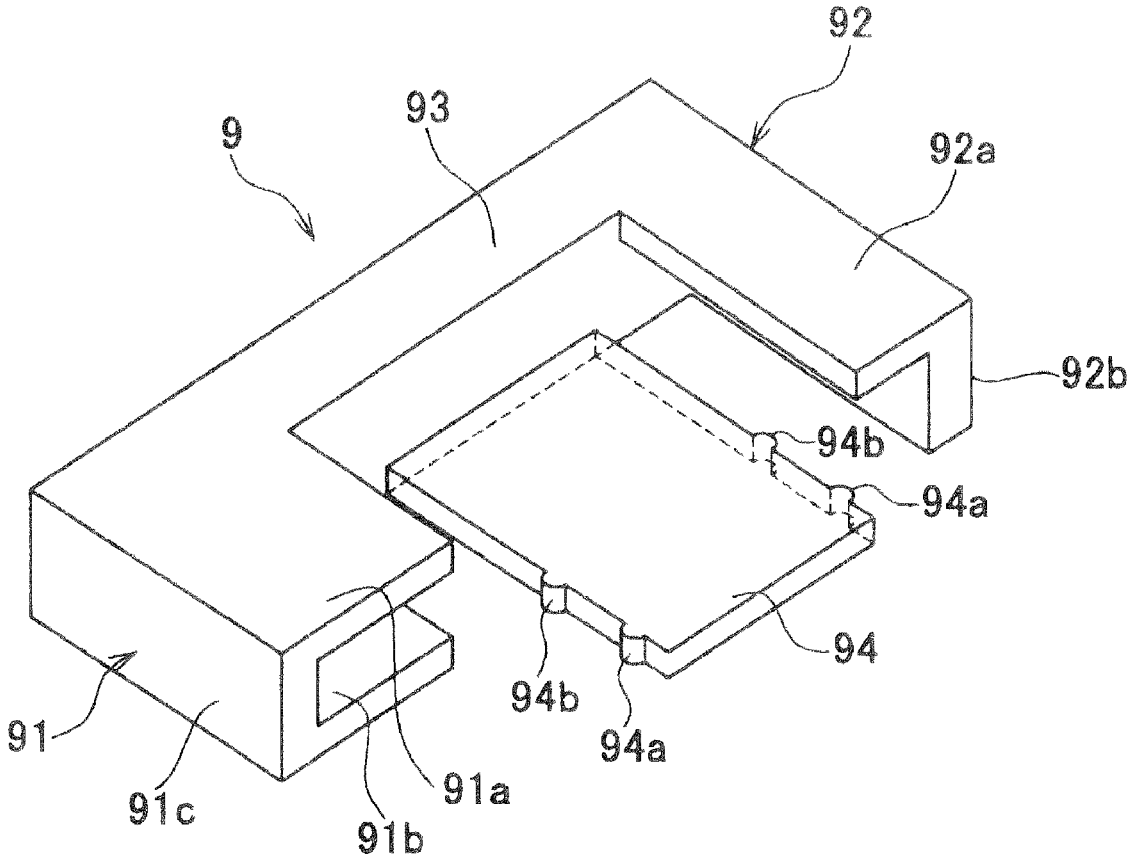
FIG. 4 is a perspective view of the locking member of the FIG. 1 connector.

The base portion 31 has an upper surface formed with a plurality of accommodating portions 31*a*. The accommodating portions 31*a* extend in the front-rear direction of the housing 3. First recesses 31*b* are formed in lower surfaces of opposite ends of the base portion 31 (see FIGS. 1A and 7). The first recesses 31*b* extend in a contact arranging direction DC. Each of the first recesses 31*b* receives part of a bottom board 91*b* of a locking portion 91 of the locking member 9. Further, second recesses (not shown) are formed in the lower surfaces of the opposite ends of the base portion 31. The second recesses are at a location rearward of the first recesses 31*b*, and extend in the contact arranging direction DC. Each of the second recesses has an inner surface formed with three pairs of engaging recesses (not shown). Each of the second recesses receives an attitude stabilizing board 94 (see FIG. 4) of each locking member 9. The three pairs of engaging recesses are engaged with first engaging protrusions 94*a* and second engaging protrusions 94*b* of the attitude stabilizing board 94 to thereby hold the associated locking member 9 in a locked position or an unlocked position.

The rear wall portion 32 is continuous with a rear of the base portion 31. The rear wall portion 32 has a plurality of accommodating portions (not shown) formed therein which are continuous with the accommodating portions 31*a* of the base portion 31. The accommodating portions of the rear wall portion 32 extend in the front-rear direction of the housing 3. The accommodating portions 31*a* of the base portion 31 and the accommodating portions of the rear wall portion 32 form contact accommodating portions. The rear wall portion 32 has opposite ends formed with rail portions 32*a*. The rail portions 32*a* extend in the contact arranging direction DC. Further, the rear wall portion 32 has a front surface formed with a recess 32*b*. The recess 32*b* receives part of a front end of the FPC 21 (see FIG. 5).

The side wall portions 33 are continuous with the opposite ends of the base portion 31. One end of each of the side wall portions 33 is continuous with the rear wall portion 32. Each side wall portion 33 has a front portion formed with a cutout 33*a*. The cutout 33*a* avoids being brought into contact with an upper board 91*a* of the locking portion 91 of each locking member 9.

The locking portions 34 are continuous with a front portion of the base portion 31. Each of the locking portion 34 has a prismatic shape and extends in the contact arranging direction DC. An upper surface of each locking portion 34 is flush with a bottom surface of the cutout 33*a* of each side wall portion 33. Each locking portion 34 has a rear surface formed with a cutout 34*a*.

The base portion 31, the rear wall portion 32, and the side wall portions 33 define an accommodating space 35. The accommodating space 35 accommodates the front end of the FPC 21.

Each of the contacts 5 includes a contact portion (not shown) and a supporting portion 5*b*, and is made of a metal. The contact portion of each contact 5 is brought into contact with a conductor (not shown) formed in the FPC 21. The supporting portion 5*b* supports the actuator 7 (see FIG. 3) such that the actuator is pivotally movable.

Each of the contacts 6 has a contact portion 6*a* and a presser portion 6*b*, and is made of a metal. The contact portion 6*a* is brought into contact with the conductor (not shown) formed in the FPC 21. The presser portion 6*b*, as described hereinafter, pushes the actuator 7 downward at a cutout 7*b* when the actuator 7 is in the closed position. The contacts 5 and the contacts 6 are alternately accommodated in the contact accommodating portions of the housing 3 (see FIG. 1B).

The actuator 7 has a substantially plate-like shape, includes cutouts 7*a*, the cutouts 7*b*, recesses 7*c*, and a shaft (not shown) (see FIG. 2), and is made of a synthetic resin. The cutouts 7*a* and the cutouts 7*b* are alternately formed in the rear of the actuator 7. Each cutout 7*a* receives the supporting portion 5*b* of the associated contact 5. Each cutout 7*b* receives the presser portion 6*b* of the associated contact 6. The recesses 7*c* are formed in the upper surface of the opposite ends of the actuator 7. The shaft extends across the cutouts 7*a*. The shaft is rotatably supported by the supporting portions 5*b* of the contacts 5. Therefore, the actuator 7 is capable of pivotally moving about the shaft between the open position and the closed position. When the actuator 7 is in the open position (position of the actuator 7 shown in FIG. 3), it is possible to accommodate the front end of the FPC 21 in the accommodating space 35. When the actuator 7 is in the closed position (position of the actuator 7 shown in FIG. 2), the actuator 7 presses the front end of the FPC 21 to the contact portions of the contacts 5 and the contact portions 6*a* of the contacts 6.

Each of the locking members 9 has the locking portion 91, an attitude maintaining portion 92, an connecting portion 93, and the attitude stabilizing board 94 (see FIG. 4), and is made of a synthetic resin.

The locking portion 91 is substantially casing-shaped, and includes the upper board 91*a*, the bottom board 91*b*, and a front board 91*c*. The locking portions 91 are mounted on the housing 3 in a manner sandwiching the respective front portions of the opposite ends of the housing 3 from above and below, and is movable in the contact arranging direction DC (the direction which is orthogonal to both of the direction of the thickness of the front end of the FPC 21 which is accommodated in the accommodating space 35, and the direction in which the FPC 21 is inserted in the accommodating space 35).

The attitude maintaining portion 92 includes an upper board 92*a* and a rear board 92*b*. The upper board 92*a* is brought into contact with an upper surface of the rail portion 32*a* of the housing 3, and the rear board 92*b* is brought into contact with a rear surface of the rail portion 32*a*. The attitude maintaining portion 92 is brought into contact with the rail portion 32*a*, whereby a change in the attitude of the locking portion 91 is reduced when the locking portion 91 slides, and hence the locking portion 91 smoothly slides.

The connecting portion 93 has a substantially prismatic shape, and connects between the locking portion 91 and the attitude maintaining portion 92.

The attitude stabilizing board 94 is continuous with a lower part of the center of the connecting portion 93. The attitude stabilizing board 94 is formed with the first engaging protrusions 94*a* and the second engaging protrusions 94*b*. The attitude stabilizing board 94 is accommodated in the second recess, not shown, of the housing 3 so as to be brought into contact with the housing 3, as described above, thereby cooperating with the attitude maintaining portion 92 to stabilize the attitude of the locking portion 91 during sliding thereof.

The locking members 9 are mounted on the opposite ends of the housing 3 such that they are each slidable between the locked position (position of the locking member 9 shown in FIG. 2) and the unlocked position (position of the locking member 9 shown in FIG. 3) along the connector arranging direction DC. If the locking members 9 are each moved from the unlocked position to the locked position when the actuator 7 is in the closed position, part of the upper board 91*a* of each locking member 9 is inserted in the recess 7*c* of the actuator 7, whereby the opening movement of the actuator 7 is blocked (locked). If the locking members 9 are each moved from the locked position to the unlocked position, the upper board 91*a* of each locking member 9 is removed from the recess 7*c* of the actuator 7, whereby the opening movement of the actuator 7 is allowed (unlocked).

A description will be given of how to use this connector with reference to FIG. 5 and other related figures.

Figure 5:
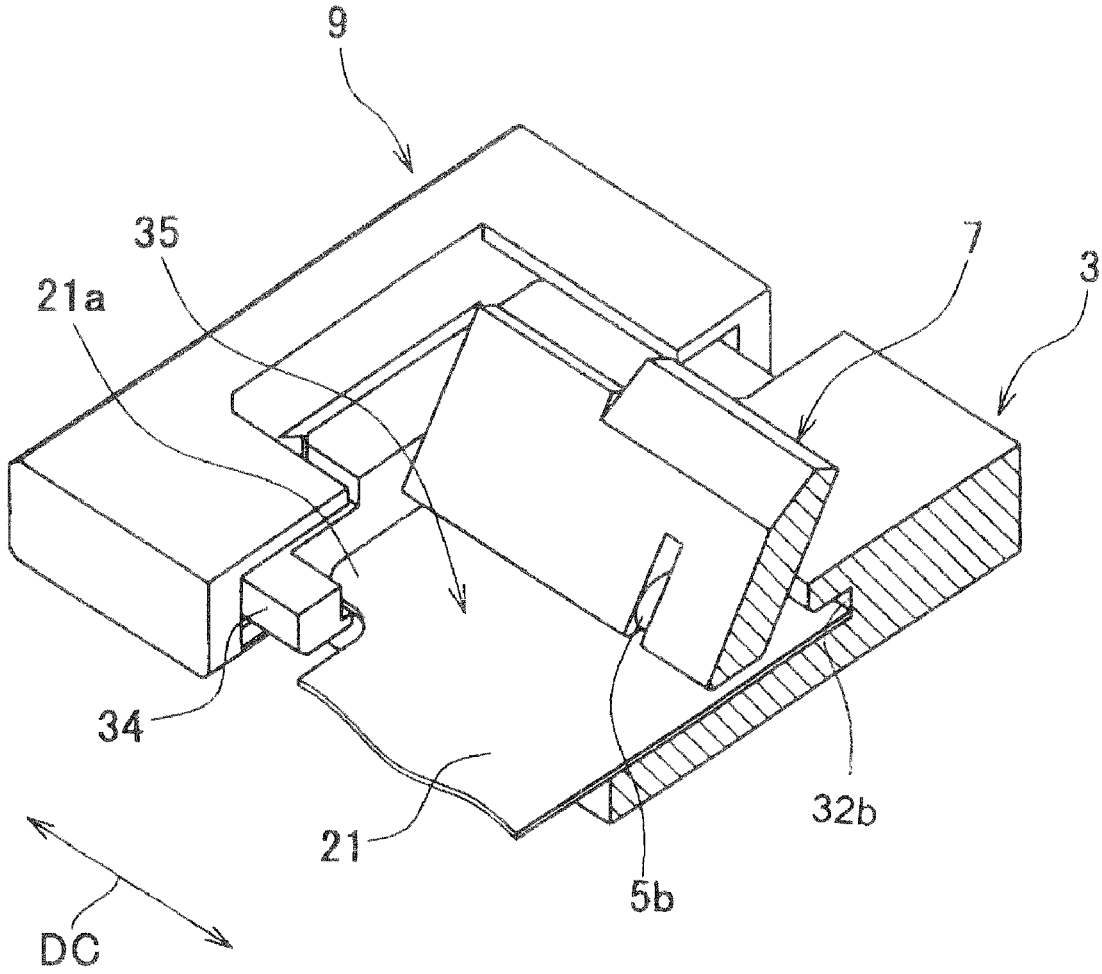
FIG. 5 is a cross-sectional view of the FIG. 1 connector in a state in which an FPC is accommodated in an accommodating space of the FIG. 1 connector, the actuator is in the open position, and the locking member is in the unlocked position.

First, as shown in FIG. 5, the front end of the FPC 21 is inserted in the accommodating space 35 of the housing 3. At this time, protruding pieces 21*a* which are formed at the front end of the FPC 21 are hooked on the locking portions 34 of the housing 3.

Figure 6:
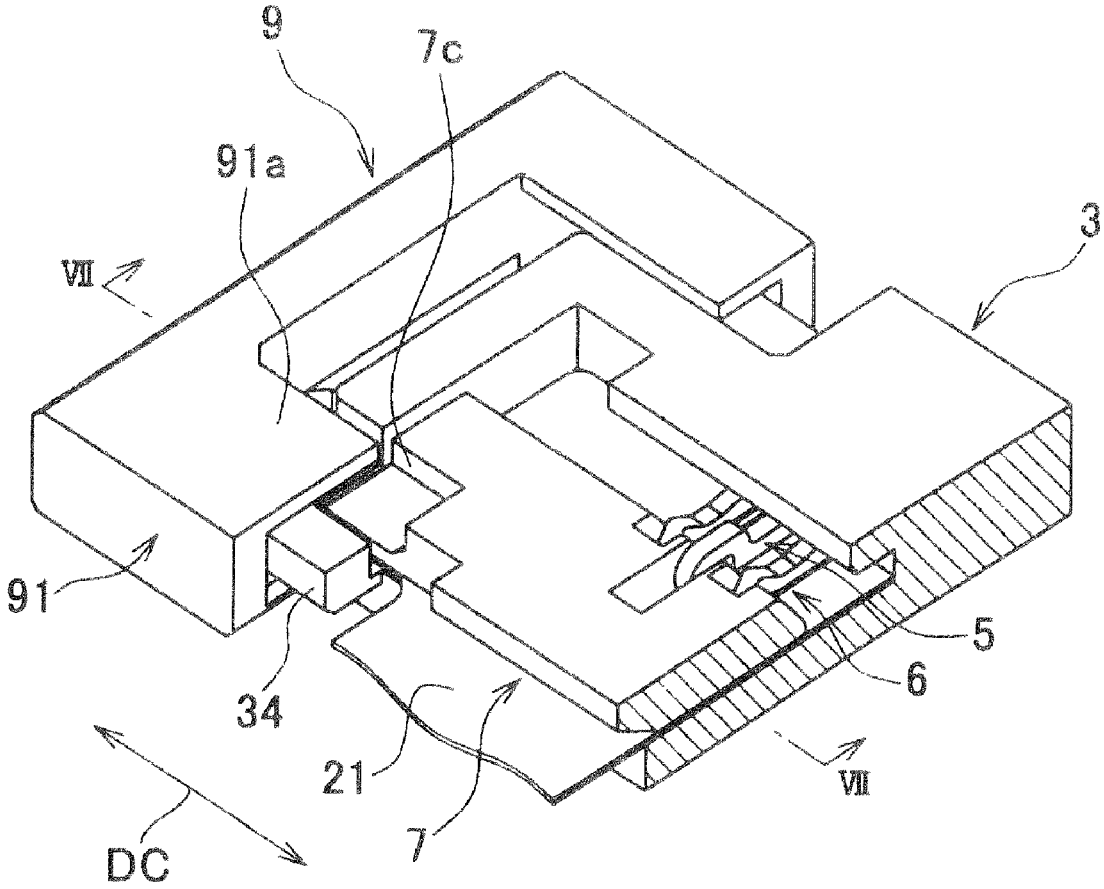
FIG. 6 is a cross-sectional view of the FIG. 1 connector in a state in which the FPC is accommodated in the accommodating space of the FIG. 1 connector, the actuator is in the closed position, and the locking member is in the unlocked position.
Figure 7:
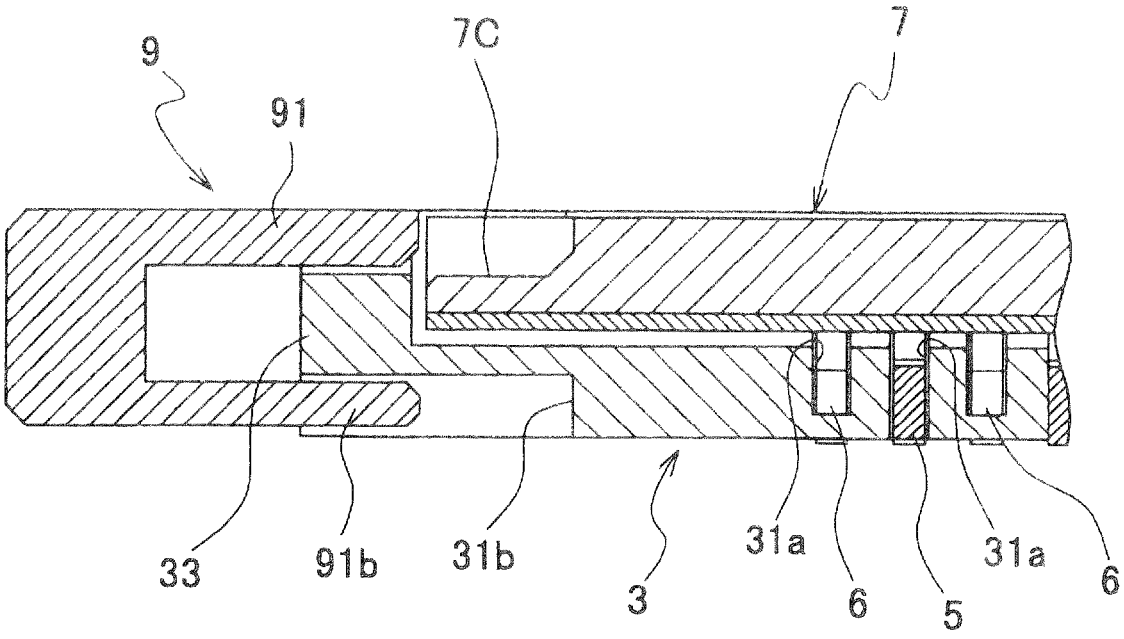
FIG. 7 is a cross-sectional view taken on line VII-VII of FIG. 6.

Next, the actuator 7 in the open position is pivotally moved in a manner tilted forward. As shown in FIGS. 6 and 7, the actuator 7 stops when it comes to the closed position. At this time, the actuator 7 presses the FPC 21 toward the contacts.

Figure 8:
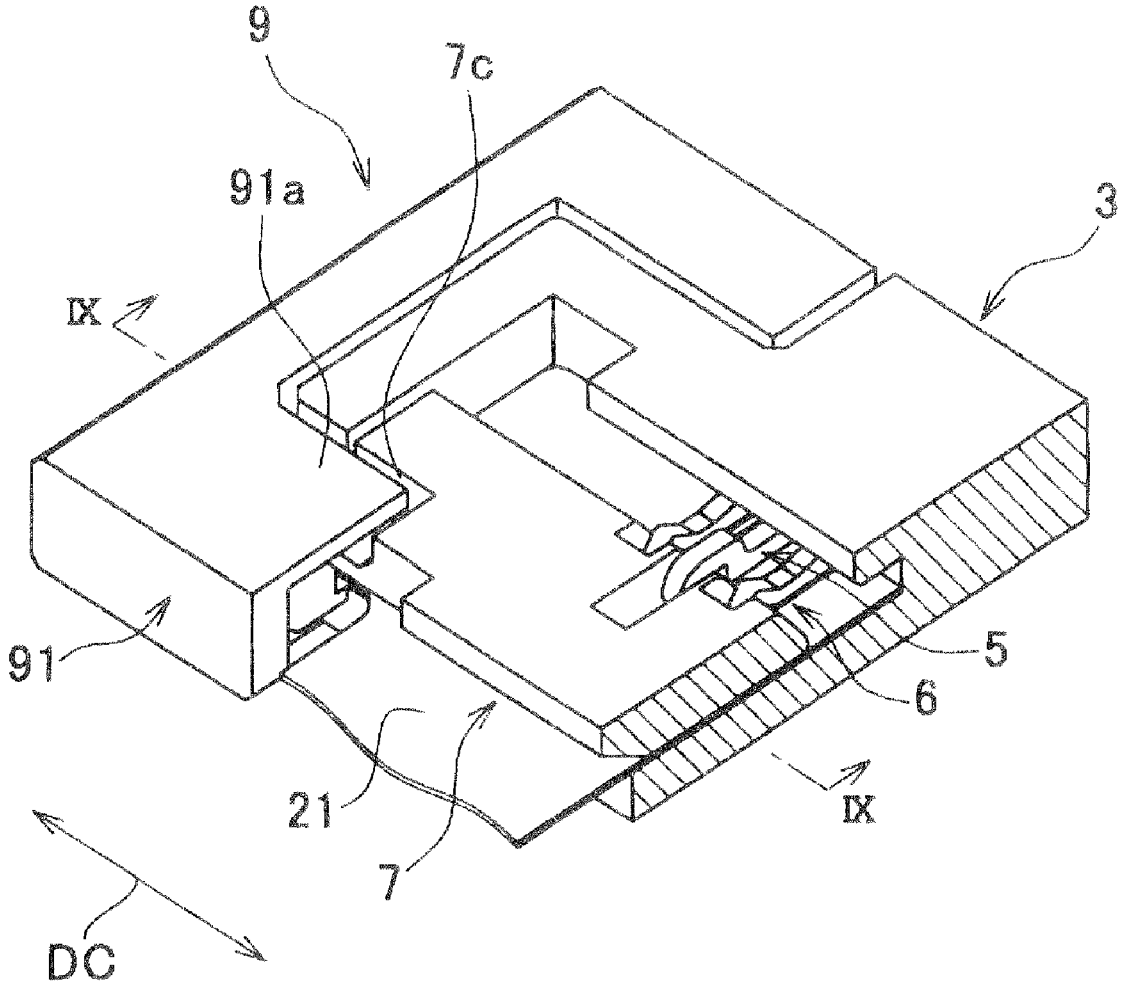
FIG. 8 is a cross-sectional view of the FIG. 1 connector in a state in which the FPC is accommodated in the accommodating space of the FIG. 1 connector, the actuator is in the closed position, and the locking member is in a locked position.
Figure 9:
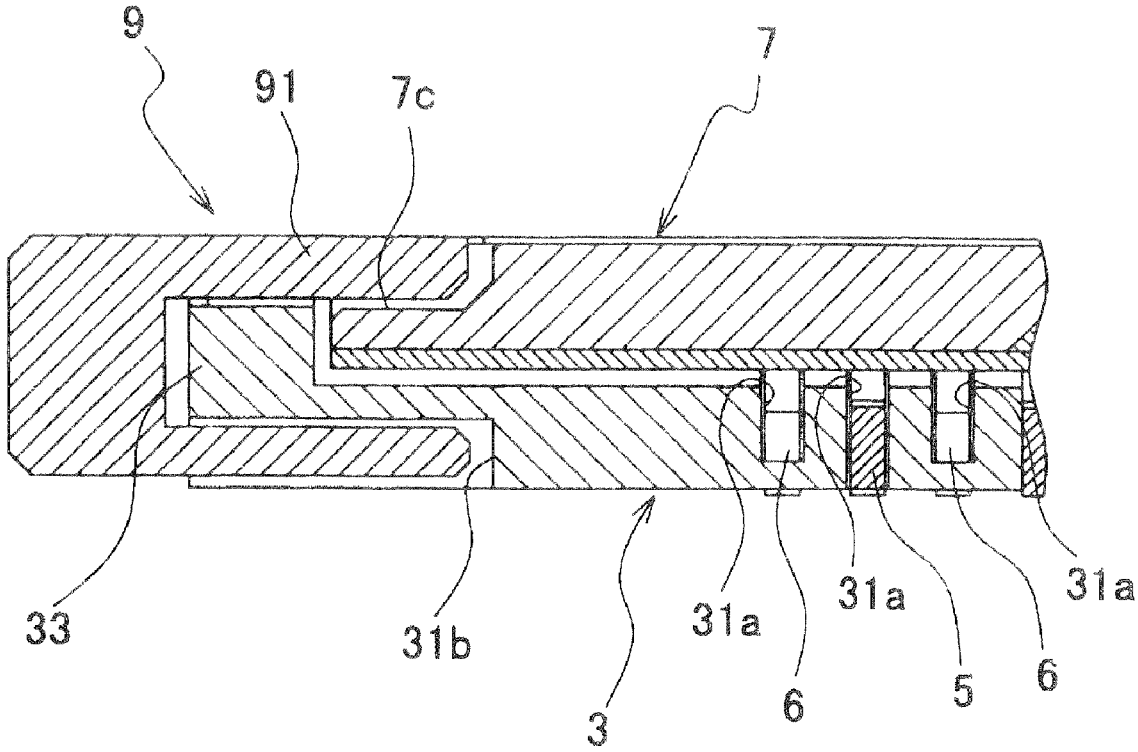
FIG. 9 is a cross-sectional view taken on line IX-IX of FIG. 8.
Figure 10A:
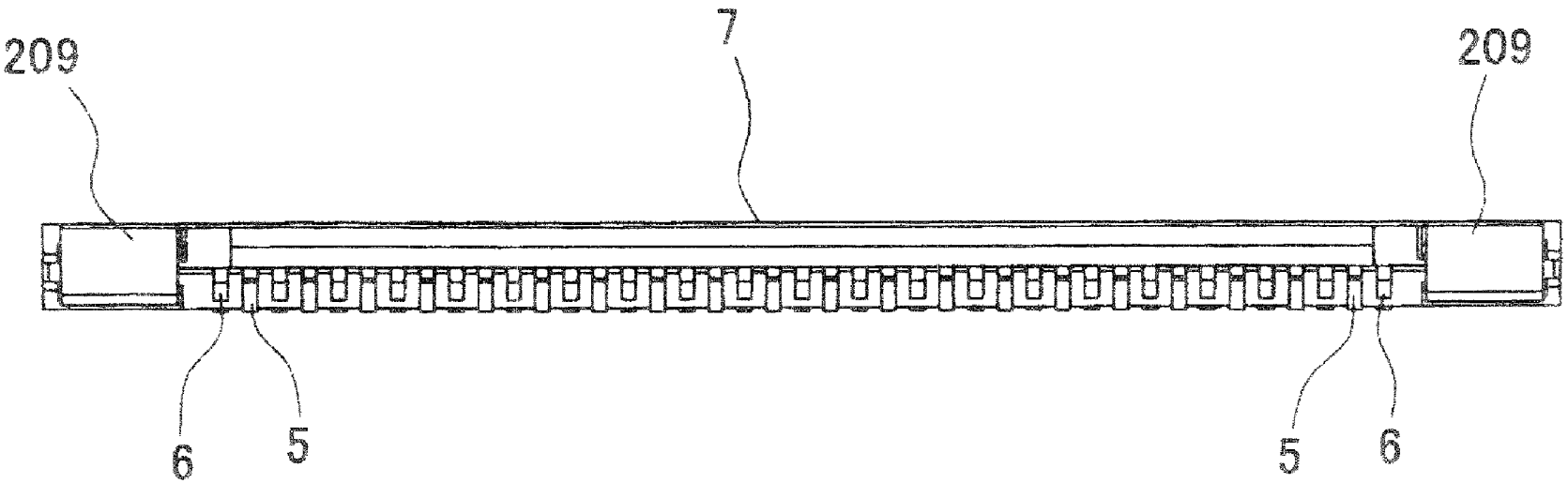
FIG. 10A is front view of a connector according to a second embodiment of the present invention.
Figure 10B:
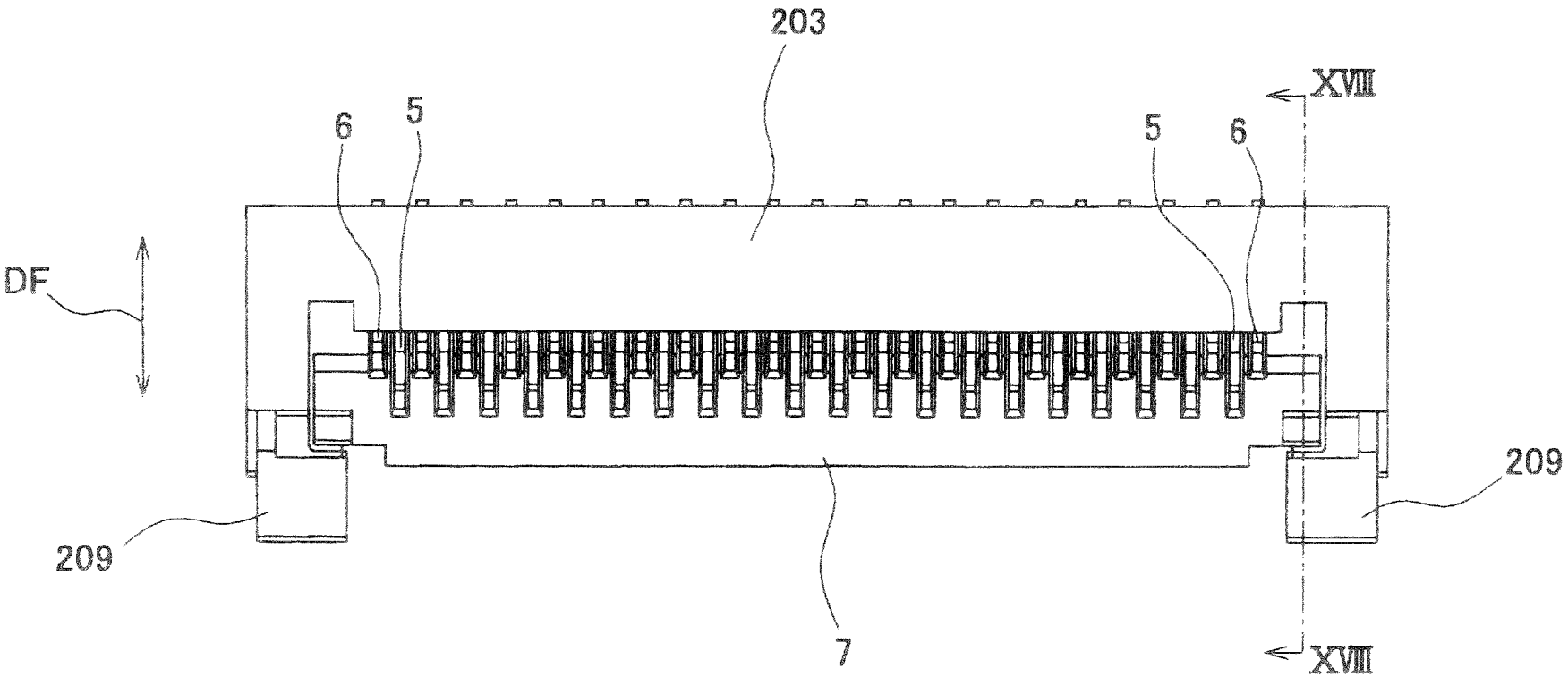
FIG. 10B is a plan view of the same.
Figure 10C:
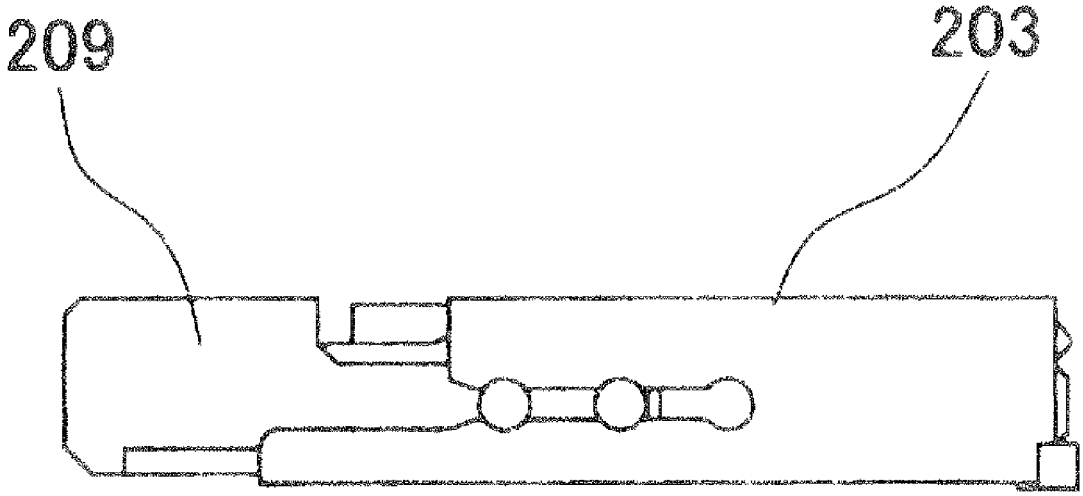
FIG. 10C is a side view of the same.
Figure 11:
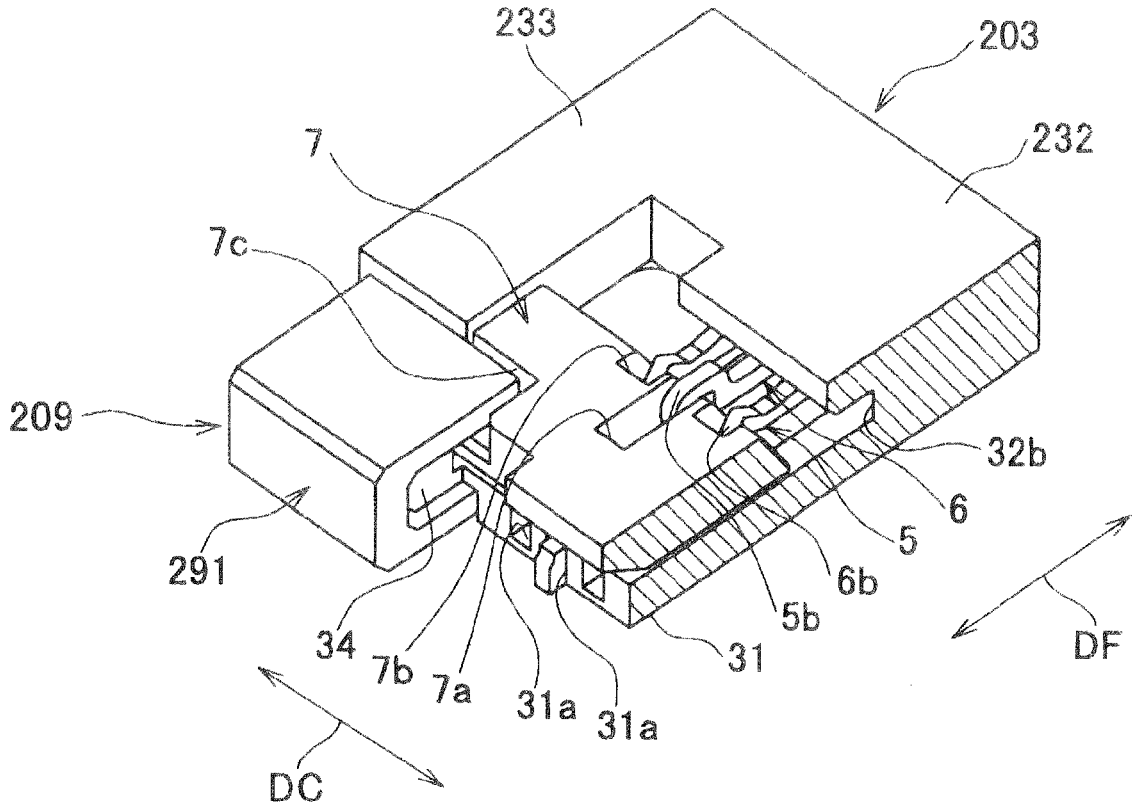
FIG. 11 is a cross-sectional view of the FIG. 10 connector in a state in which a locking member of the FIG. 10 connector is in a locked position, and an actuator in a closed position is locked.

Then, each locking member 9 in the unlocked position is slid toward the actuator 7. As shown in FIGS. 8 and 9, each locking member 9 stops when it comes to the locked position. At this time, part of the upper board 91*a* of each locking member 9 is inserted in the recess 7*c* of the actuator 7.

In this state, if force acts part of the FPC 21 protruding from the accommodating space 35 in a manner lifting the part up in the direction of the height of the connector, the actuator 7 attempts to pivotally move toward the open position. However, the upper board 91*a* of each locking member 9 is located in the pivotal orbit of the actuator 7, and hence the actuator 7 is brought into abutment with the upper board 91*a* of each locking member 9, which prevents the actuator 7 from pivotal motion. Therefore, the locked state of the actuator 7 is maintained.

Further, the protruding pieces 21*a* formed at the front end of the FPC 21 are hooked on the locking portions 34 of the housing 3. Therefore, even when force acts on the FPC 21 in a pull-out direction, the FPC 21 cannot be pulled out from the accommodating space 35.

As described above, according to the first embodiment, even if the FPC 21 is pulled in the direction of the height of the connector, or pulled in the pull-out direction, it is possible to positively maintain the locked state of the actuator 7.

Next, a connector according to a second embodiment of the present invention will be described with reference to FIG. 10A to FIG. 15.

Component parts identical to those of the connector according to the first embodiment are denoted by identical reference numerals, and detailed description thereof is omitted, while only main component parts different in construction from those of the first embodiment will be described hereinafter.

The connector according to the second embodiment is distinguished from the connector according to the first embodiment in which the sliding direction of the locking member 9 coincides with the contact arranging direction DC, in that the sliding direction of a locking member 209 coincides with a front-rear direction DF of a housing 203 (direction which is substantially orthogonal to both of the direction of the thickness of part of the object to be connected and the contact arranging direction).

Figure 12:
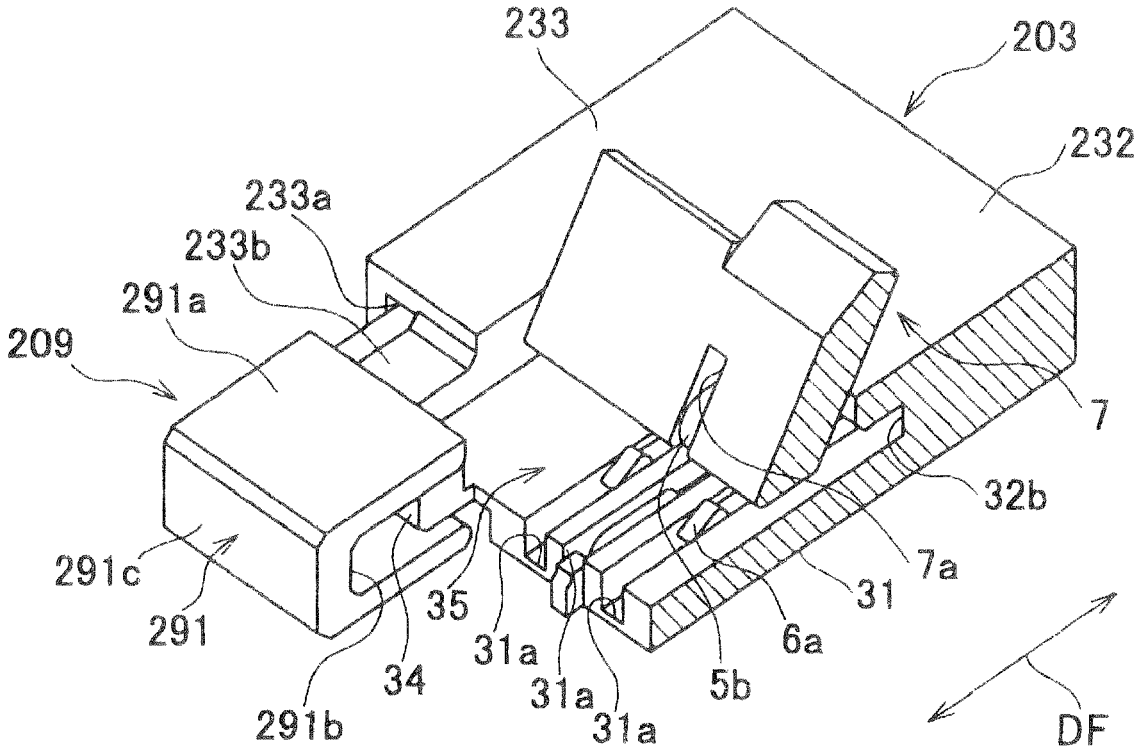
FIG. 12 is a cross-sectional view of the FIG. 10 connector in a state in which the locking member of the FIG. 10 connector is in an unlocked position, and the actuator is in the open position.

Although in the connector according to the first embodiment, the rail portions 32*a* are formed at the opposite ends of the rear wall portion 32 of the housing 3, in the connector according to the second embodiment, as shown in FIG. 12, no rail portions are formed on a rear wall portion 232 of the housing 203, but instead, rail portions 233*b* are formed on respective front portions of side wall portions 233. The rail portions 233*b* extend in the front-rear direction DF.

Further, each of the side wall portions 233 is formed with an accommodating space 233*a*. The accommodating space 233*a* extends in the front-rear direction DF.

Figure 13:
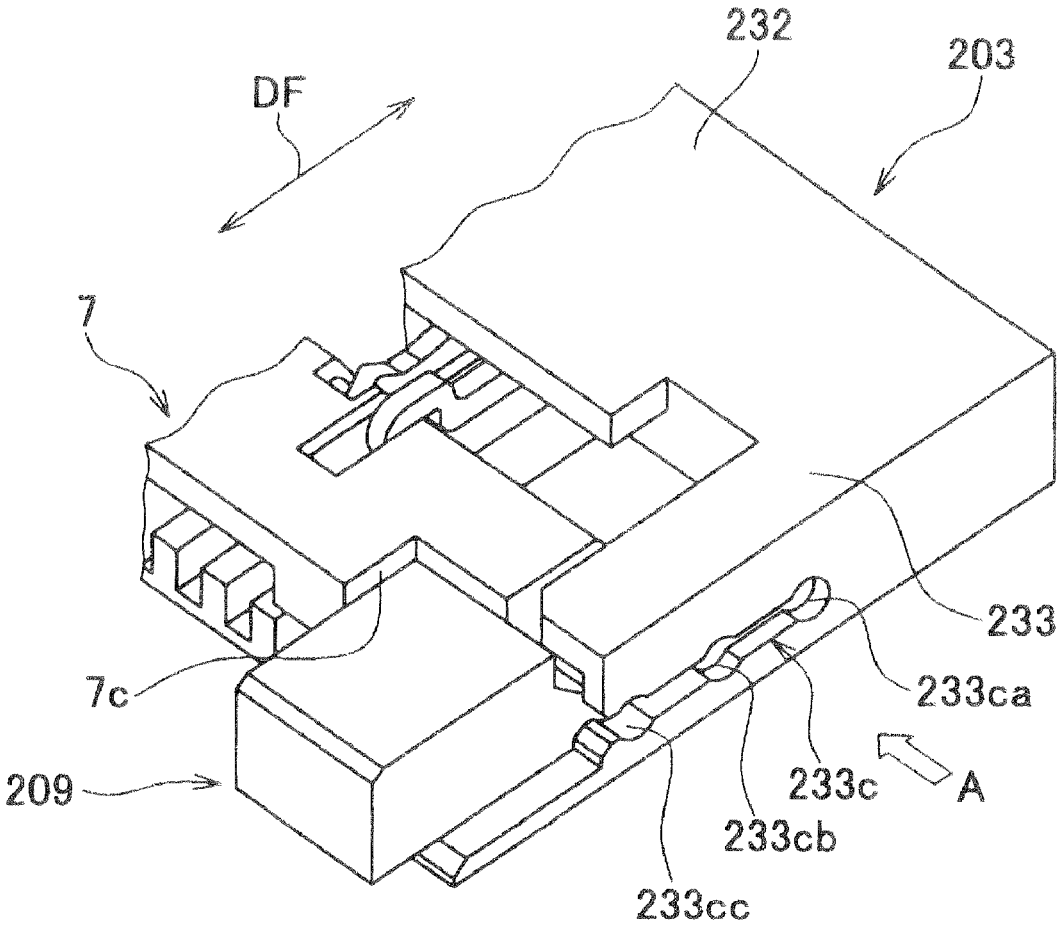
FIG. 13 is a perspective view of one end of the FIG. 10 connector.
Figure 14:
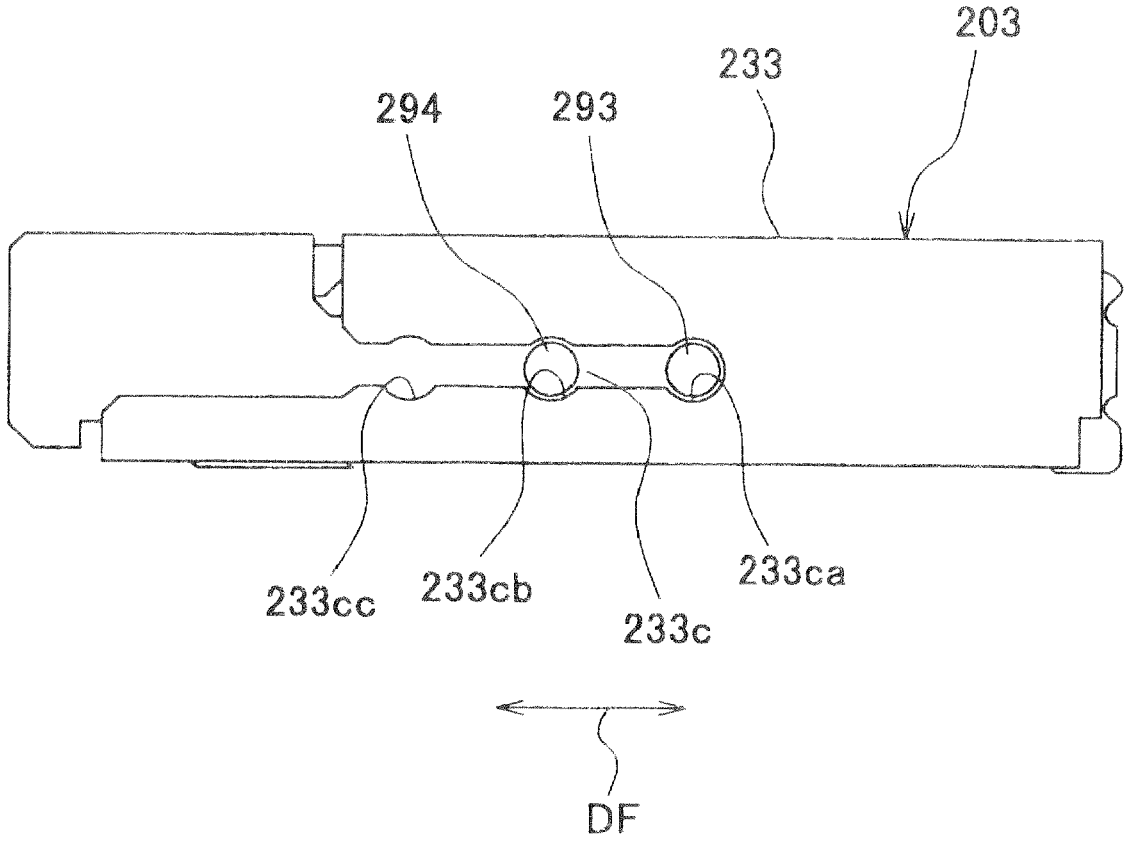
FIG. 14 is a view taken in the direction of an arrow A in FIG. 13.

Furthermore, as shown in FIGS. 13 and 14, each of the side wall portions 233 is formed with a slit 233*c* opening in a side surface thereof. The slit 233*c* includes a first recess 233*ca*, a second recess 233*cb*, and a third recess 233 cc, and these recesses are arranged at equally-spaced intervals.

Figure 15:
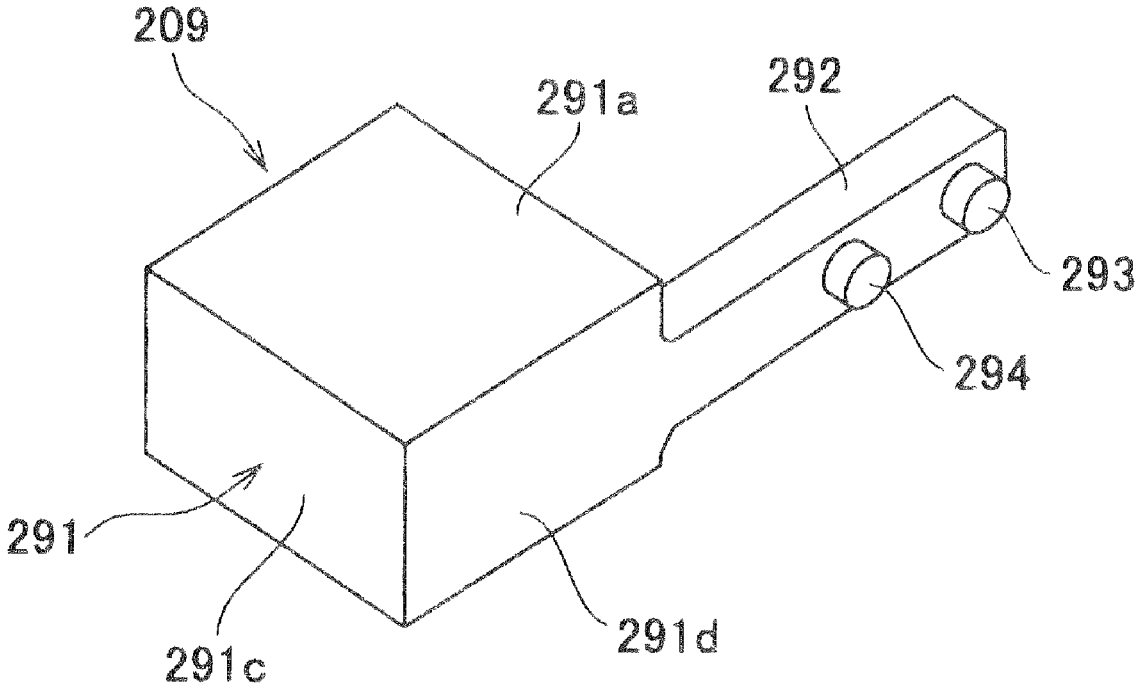
FIG. 15 is a perspective view of the locking member of the FIG. 10 connector.

As shown in FIG. 15, each locking member 209 according to the second embodiment includes a locking portion 291, an insertion portion 292, a first pin portion 293, and a second pin portion 294, and is made of a synthetic resin.

Each locking portion 291 is substantially casing-shaped, and includes an upper board 291*a*, a bottom board 291*b*, a front board 291*c* and a side board 291*d*. Each locking portion 291 is mounted in the housing 203 in a manner sandwiching the front portion of each end of the housing 203, and is movable in the front-rear direction DF.

The insertion portion 292 has a substantially prismatic shape, and is continuous with the rear of the locking portion 291. The insertion portion 292 is slidably inserted in the accommodating space 233*a* of the housing 203. This causes the locking portions 209 to be mounted on the opposite ends of the housing 203, respectively, such that they are each slidable between the locked position (position of the locking portion 209 shown in FIG. 11) and the unlocked position (position of the locking member 209 shown in FIG. 12) along the front-rear direction DF.

The first pin portion 293 and the second pin portion 294 are arranged on the side surface of the insertion portion 292 in a manner spaced from each other. When the first pin portion 293 and the second pin portion 294 are engaged with the first recess 233*ca* and the second recess 233*cb* of the housing 203, respectively, each locking member 209 is maintained in the locked position, whereas when the first pin portion 293 and the second pin portion 294 are engaged with the second recess 233*cb* and the third recess 233*cc*, respectively, each locking member 209 is maintained in the unlocked position.

If the locking members 209 are each moved from the unlocked position to the locked position when the actuator 7 is in the closed position, part of the upper board 291*a* of each locking member 209 is inserted in the recess 7*c* of the actuator 7 to thereby inhibit the actuator 7 from opening. If the locking members 209 are each moved from the locked position to the unlocked position, the upper board 291*a* of each locking member 209 is removed from the recess 7*c* of the actuator 7 to thereby allow the actuator 7 to open.

A description will be given of how to use this connector with reference to FIG. 16 and other related figures.

Figure 16:
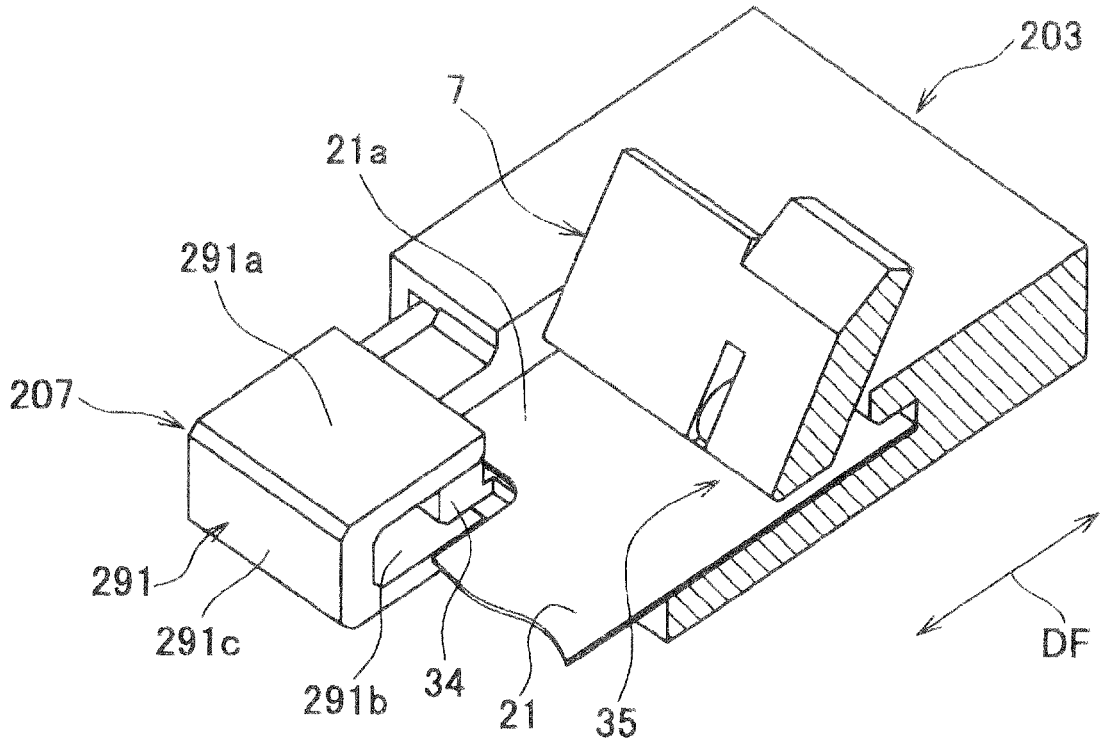
FIG. 16 is a cross-sectional view of the FIG. 10 connector in a state in which the FPC is accommodated in an accommodating space of the FIG. 10 connector, the actuator is in the open position, and the locking member is in the unlocked position.

First, as shown in FIG. 16, the front end of the FPC 21 is inserted in the accommodating space 35 of the housing 203. At this time, the protruding pieces 21*a* formed at the front end of the FPC 21 are hooked on the locking portions 34 of the housing 203.

Figure 17:
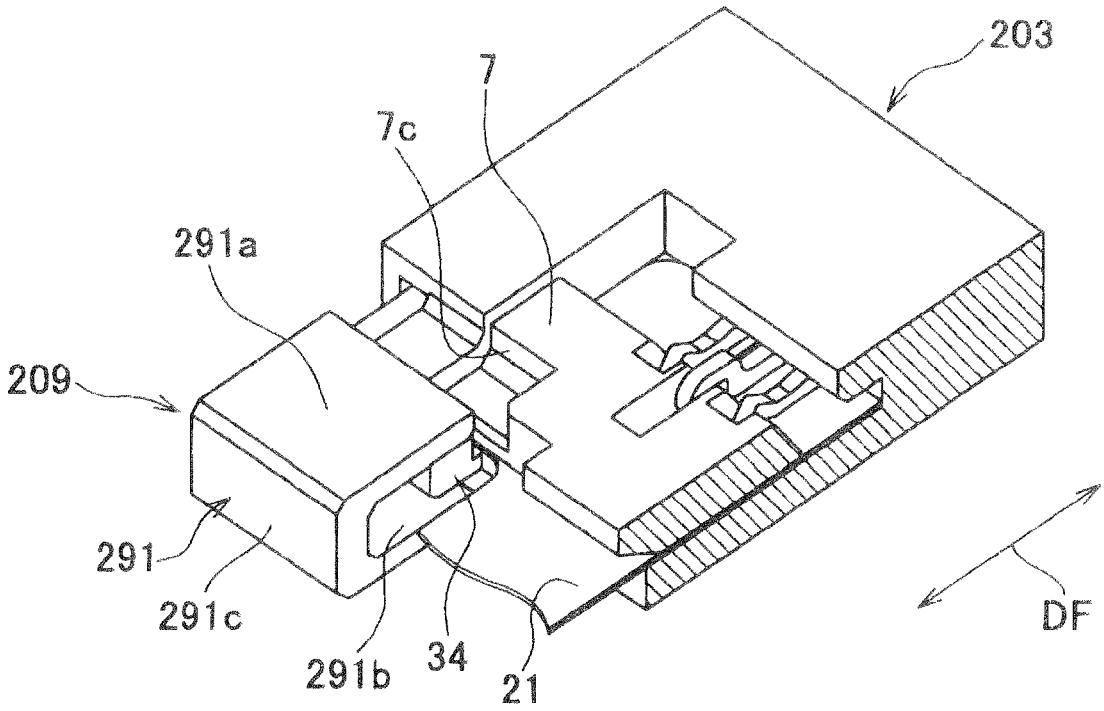
FIG. 17 is a cross-sectional view of the FIG. 10 connector in a state in which the FPC is accommodated in the accommodating space of the FIG. 10 connector, the actuator is in the closed position, and the locking member is in the unlocked position.
Figure 18:
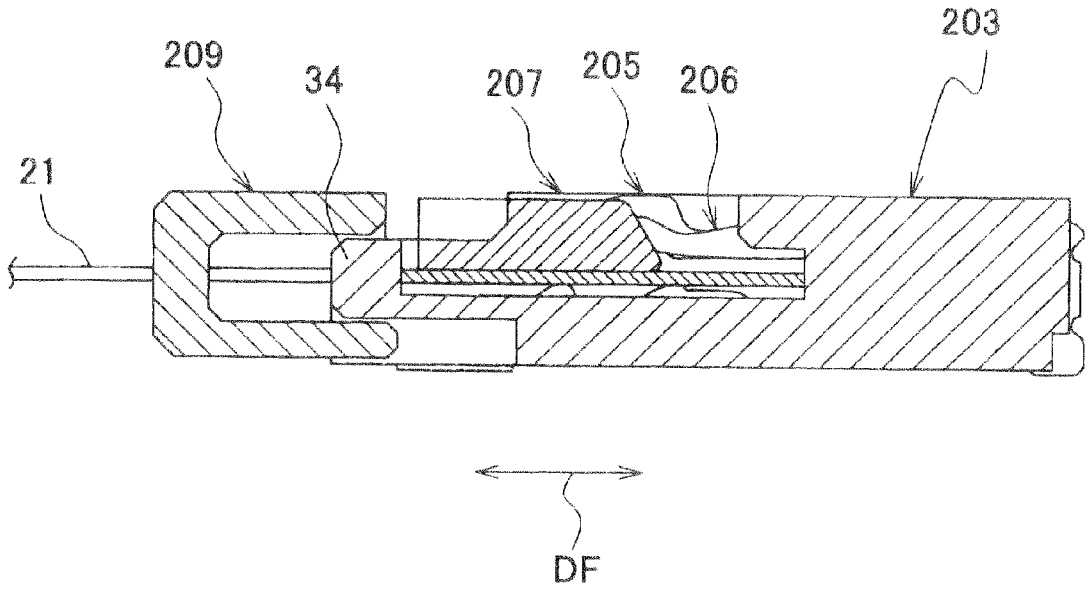
FIG. 18*a* cross-sectional view taken on line XVIII-XVIII of FIG. 10B in a state in which the FPC is accommodated in the accommodating space of the FIG. 10 connector, the actuator is in the closed position, and the locking member is in the unlocked position.

Next, the actuator 7 in the open position is rotated in a manner tilted forward. As shown in FIGS. 17 and 18, the actuator 7 stops when it comes to the closed position.

Figure 19:
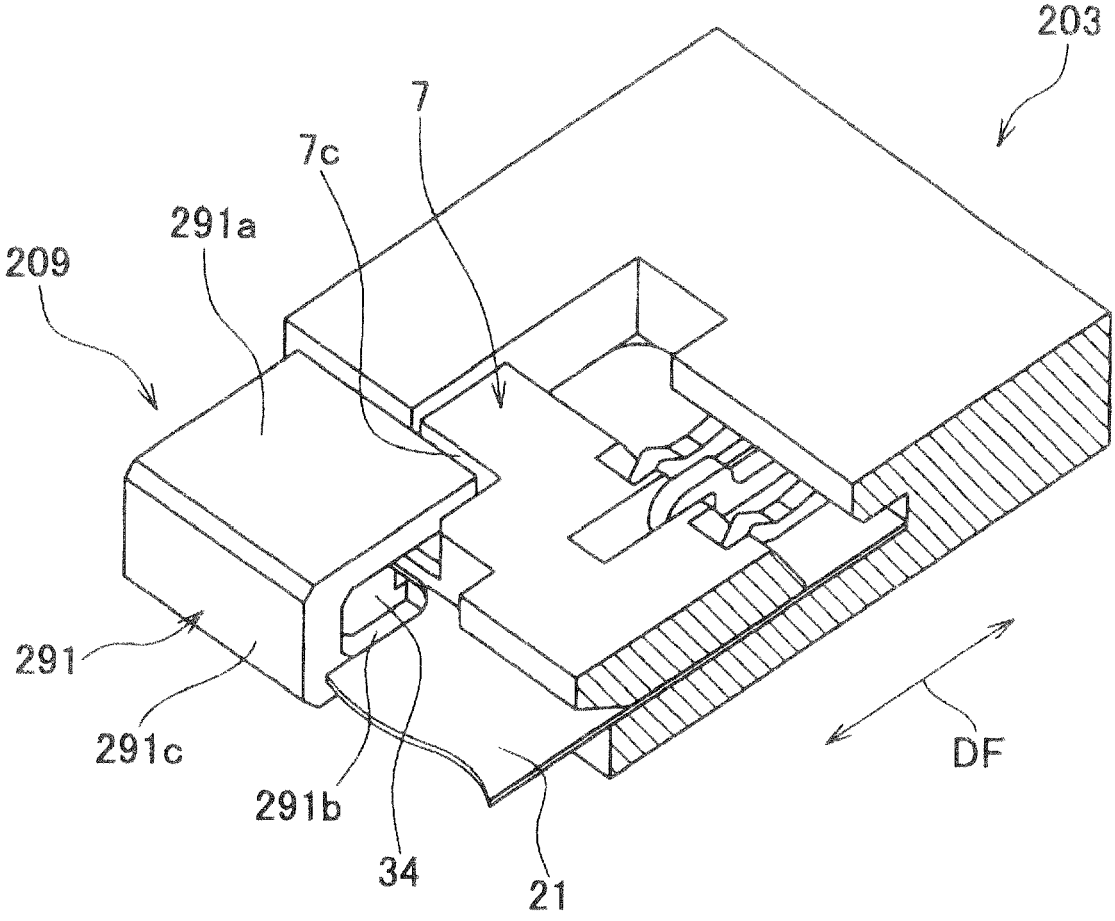
FIG. 19 is a cross-sectional view of the FIG. 10 connector in a state in which the FPC is accommodated in the accommodating space of the FIG. 10 connector, the actuator is in the closed position, and the locking member is in the locked position.
Figure 20:
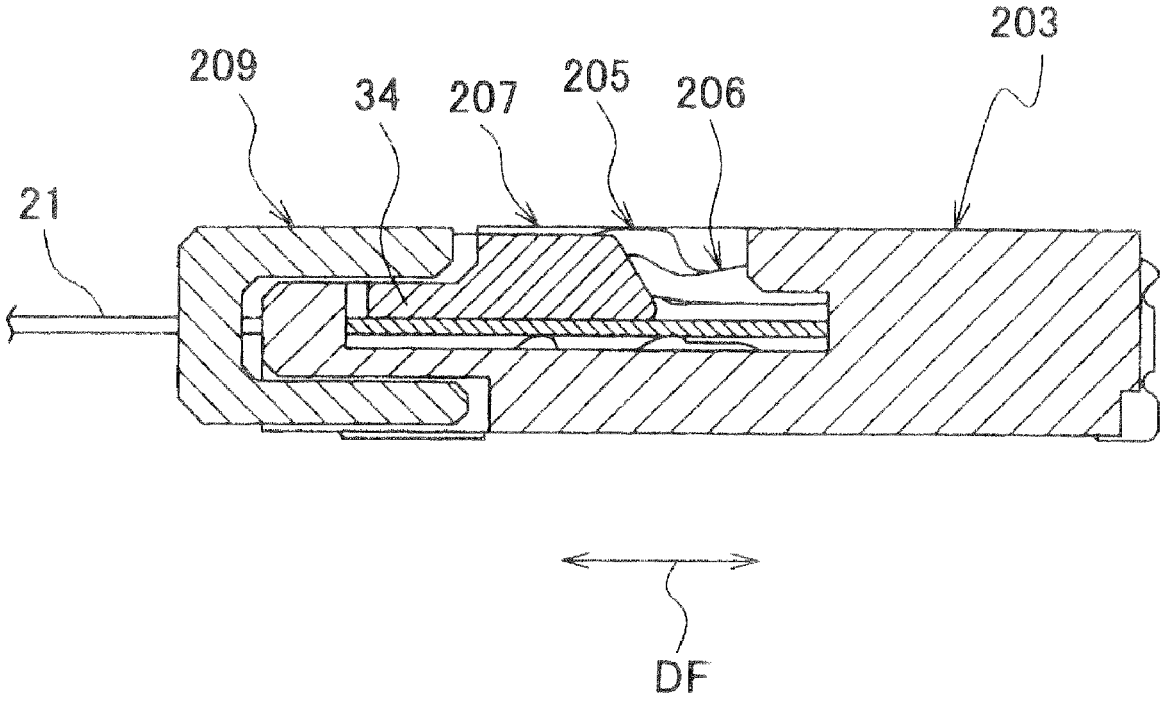
FIG. 20 is a cross-sectional view of the FIG. 10 connector in a state in which the FPC is accommodated in the accommodating space of the FIG. 10 connector, the actuator is in the closed position, and the locking member is in the locked position.

Then, each locking member 209 in the unlocked position is slid. As shown in FIGS. 19 and 20, each locking member 209 stops when it comes to the locked position. At this time, part of the upper board 291*a* of each locking member 209 is inserted in the recess 7*c* of the actuator 7.

In this state, if force acts on part of the FPC 21 protruding from the accommodating space 35 of the housing 203 in a manner lifting up the part in the direction of the height of the connector, the actuator 7 attempts to pivotally move toward the open position. However, the actuator 7 is brought into abutment with the upper board 291*a* of each locking member 209, and hence it is impossible to rotate the actuator 7. Therefore, the locked state of the actuator 7 is maintained.

As described above, according to the second embodiment, the same advantageous effects as provided by the first embodiment are obtained.

Although in the above-described embodiments, the actuator 7 is mounted in the housings 3 and 203 such that they are pivotally movable on the contacts 5, shafts may be formed at the opposite ends of the actuator 7, and the shafts may be rotatably supported by bearings which are directly formed on the housing, or the actuator 7 may be rotatably supported by the contacts and the housing.

Further, although in the above-described embodiments, the FPC 21 is employed as the flat object to be connected, the flat object to be connected is not limited to the FPC 21, but for example, an FFC or the like may be used.

It is further understood by those skilled in the art that the foregoing are the preferred embodiments of the present invention, and that various changes and modification may be made thereto without departing from the spirit and scope thereof.

What is claimed is:

1. A connector comprising:

a housing that has an accommodating space for accommodating part of a flat object to be connected;

a plurality of contacts that are fixed in said housing and arranged in a given direction;

an actuator which is mounted on said housing such that said actuator is pivotally movable between an open position for accommodating the part of said object to be connected into said accommodating space and a closed position for pressing the part of said object to be connected against said contacts; and a locking member which is mounted on said housing such that said locking member is slidable between a locked position to inhibit said actuator in said closed position from opening and an unlocked position to allow said actuator in said closed position to open, along a direction which is orthogonal to a direction of a thickness of the part of said object to be connected.

2. A connector as claimed in claim 1, wherein the direction of sliding of said locking member is the direction of arrangement of said contacts.

3. A connector as claimed in claim 1, wherein the direction of sliding of said locking member is substantially orthogonal to both of the direction of the thickness of the part of said object to be connected and the direction of arrangement of said contacts.

* * * * *